United States Patent [19]

Yamaguchi et al.

[11] Patent Number: 4,634,626

[45] Date of Patent: Jan. 6, 1987

[54] CORROSION-PREVENTING STRUCTURE

[75] Inventors: Ikutoshi Yamaguchi, Chigasaki; Katsuhiko Kashiwagi, Yokohama; Hideo Goto, Yokosuka; Susumu Inoue, Yokohama, all of Japan

[73] Assignee: Bridgestone Corporation, Tokyo, Japan

[21] Appl. No.: 828,126

[22] Filed: Feb. 11, 1986

[30] Foreign Application Priority Data

Feb. 15, 1985 [JP] Japan ..... 60-26371

[51] Int. Cl.[4] ..... B32B 13/00; B32B 3/26

[52] U.S. Cl. ..... 428/312.4; 428/316.6; 428/317.1; 428/317.7; 428/703

[58] Field of Search ..... 428/312.4, 316.6, 317.1, 428/317.3, 317.7, 703

[56] References Cited

U.S. PATENT DOCUMENTS 4,193,831 3/1980 Fujii et al. ..... 428/703
4,292,364 9/1981 Wesch et al. ..... 428/703
4,559,263 12/1985 Roodvoets ..... 428/312.4

FOREIGN PATENT DOCUMENTS 7019 2/1981 Japan ..... 428/703

*Primary Examiner*—William J. Van Balen
*Attorney, Agent, or Firm*—Sughrue, Mion, Zinn, Macpeak, and Seas

[57] ABSTRACT

A corrosion-preventing structure for protecting reinforcing bars in reinforced concrete from corrosion. This corrosion-preventing structure comprises an adhesive layer, a swelling agent layer with a water-absorbing polymer blended therein, and a protective cover layer which layers are successively formed onto the surface of the reinforced concrete to be protected from corrosion.

9 Claims, 5 Drawing Figures

CORROSION-PREVENTING STRUCTURE

BACKGROUND OF THE INVENTION

1. Field of the Invention

The present invention relates to a corrosion-preventing structure for reinforced concrete to be protected from corrosion.

2. Related Art Statement

In applying a noncorrosive tape or the like onto the surface of an object to be protected from corrosion, it has been a conventional practice that a corrosion-preventing layer such as a noncorrosive tape or the like is pushed against the object to be protected from corrosion by covering the corrosion protecting layer with a rigid plastic protective cover from the outside thereof so as to maintain performance and durability of the corrosion-preventing layer. In this case, if the outer surface of the object to be protected from corrosion is uneven, unevenness is produced on the outer surface of the corrosion-preventing layer covering the object, so that gap is partially formed between the protective cover and the corrosion-preventing layer. Accordingly, there occurs a problem that even if the protective cover is pushed toward the corrosion-preventing layer, the corrosion-preventing layer can not be fully adhered to the object to be protected from corrosion.

In order to remove such a defect, it has been heretofore trially adopted to adhere the corrosion-preventing layer onto the surface of the object to be protected from corrosion by interposing a plastic foam between the corrosion-preventing layer and the protective cover so that tightening force originated from the protective cover may be given to the corrosion-preventing layer through the deformation action possessed by the foam.

However, the plastic foam is likely to be fatigued through occurrence of creep compression permanent set. Thus, it is difficult to expect the effects of the plastic foam for a long time period, and therefore it is not easy to obtain a durable corrosion-preventing structure.

SUMMARY OF THE INVENTION

It is an object of the present invention to provide a corrosion-preventing structure for reinforced concrete, which eliminates the above-mentioned problems.

According to the gist of the present invention, there is a provision of a corrosion-preventing structure for protecting reinforcing bars in reinforced concrete from corrosion in which an adhesive layer as a corrosion-preventing layer, a swelling agent layer in which a water-absorbing polymer is blended, and a protective cover layer are successively applied onto the surface of the reinforced concrete to be protected from corrosion.

According to a preferred embodiment according to the present invention, there is a provision of the corrosion-preventing structure for protecting the reinforcing bars in the reinforced concrete from corrosion in which a foam layer is interposed between the adhesive layer and the swelling agent layer.

According to another preferred embodiment of the present invention, there is a provision of the corrosion-preventing structure for protecting the reinforcing bars in the reinforced concrete from corrosion in which only the outer half portion of the swelling agent layer is blended with a water absorbing polymer and a waterproof effect is confered upon the inner half portion thereof to render only the outer half portion as the swelling agent layer.

By constructing the corrosion-preventing structure as mentioned above, corrosion-preventing effects can be improved.

These and other objects, features, and advantages of the invention will be well appreciated upon reading of the following description of the invention when taken in connection with the attached drawing with understanding that some modifications, variations and changes could be easily done by the skilled in the art to which the invention pertains without departing from the spirit of the invention or the scope of claims appended hereto.

BRIEF DESCRIPTION OF THE DRAWING

For a better understanding of the invention, reference is made to the attached drawing, wherein.

DETAILED DESCRIPTION OF THE INVENTION

Figure 1:
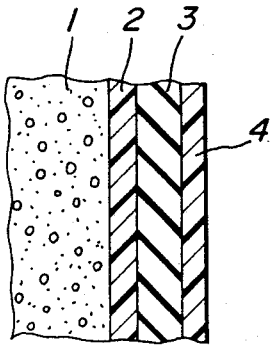
FIG. 1 is a cross sectional view showing an embodiment of the corrosion-preventing structure according to the present invention.

As an adhesive constituting the adhesive layer in the corrosion-preventing structure according to the present invention, use may be made of (1) butyl rubber as a main component (2) a petrolatum adhesive which is a white or brown translucent gelatinous substance being a kind of petroleum waxes isolated through reduced pressure distillation from crude oil and mainly consists of paraffinic and olefinic hydrocarbons and the adhesive exhibits its corrosion property. A thin film of polyethylene or vinyl chloride or an unwoven cloth is adopted as a substrate, if necessary.

The swelling agent may include ones in which a water-absorbing polymer is blended into unvulcanized rubber, vulcanized rubber or other plastics as a substrate and which has a coefficient of cubical expansion of 5 to 1,000%.

As the water absorbing polymer, mention may be made of crosslinked polyvinyl alcohol, acrylonitrile-vinyl acetate copolymer, crosslinked polyacrylate, methyl methacrylate-vinyl acetate copolymer, maleic anhydride-isobutylene copolymer, styrene-butadiene-styrene-thioglycolic acid copolymer, styrene-butadiene-styrene-maleic anhydride copolymer, hydrophilic polyurethane, hydrophilic epoxide and the like. One or more of them are blended into the vulcanized rubber, unvulcanized rubber or plastics. Further, a hydrophilic component such as ethylene glycol, propylene glycol, polyethylene glycol, polypropylene glycol and the like may be blended in addition to the above-recited polymers.

As rubber or plastics into which the above water-absorbing polymer is blended, mention may be made of natural rubber (NR), synthesized isoprene rubber (IR), styrene-butadiene copolymer rubber (SBR), butyl rubber (IIR), butadiene rubber (BR), chloroprene rubber (CR), nitrile rubber (NBR), ethylene-propylene rubber (EPR), polyurethane, chlorinated polyethylene, ethylene-vinyl acetate copolymer (EVA), polystyrene, polyvinyl chloride and the like.

It is preferable that the swelling agent in which the water absorbing polymer is blended into rubber or plastics has a cubical expansion of 5–1,000%, preferably 30–300% when placed in pure water.

The swelling agent with the cubical expansion of less than 30% does not give the effect as the corrosion-preventing structure. The swelling agent with a cubical expansion of more than 1,000% poses a problem on the pressure resistance of the protective cover. The larger the cubical expansion, the lower the properties of the swelling agent, and the poorer the durability.

By way of example, the swelling agent suitably used in the present invention will be shown in the following.

| | | |
|---|---|---|
| Cubical expansion (%) | 150 | 800 |
| Elongation (%) | 600 | 1,000 |
| Strength (kg/cm$^2$) | 163 | 12 |
| 300% stress (kg/cm$^2$) | 37 | 10 |

When the swelling agent layer is composed of the two different layers as mentioned above, two kinds of the swelling agents in which the water-absorbing polymer is blended or no water-absorbing polymer is blended are separately treated during kneading and rolling steps, which are then laminated together in a molding step. If the unvulcanized rubber is used as the substrate, the laminate is used as it is. When the vulcanizable rubber is used as the substrate, the laminate is integrated in a press through vulcanization.

When the swelling agent layer is designed in the double layer structure as mentioned above, waterproof effect is given to the swelling agent layer on the side of the adhesive layer. Thus, the interruption of water is performed twice to further improve the corrosion-preventing effect.

The protective cover is made from a rigid material having corrosion resistance and durability, such as FRP.

According to the corrosion-preventing structure of the present invention, a foam layer may be further interposed between the adhesive layer and the swelling agent layer. As such a foam layer, use may be made of a closed cell foam of rubber or plastics, for instance, closed cell foams of polyethylene, polypropylene, synthetic rubber and natural rubber.

By the provision of the foam between the adhesive layer and the swelling agent layer, a gap formed by the uneven surface of the reinforced concrete can be completely buried through the volume-swelling of the swelling agent in combination with the foam.

As the materials constituting the foam, mention may be made of NR, SBR, CR, IIR, BR, EPR, PE, polystyrene, EVA, polyurethane, and the like.

IIR, EPR and CR with small water absorbing property are desired in view of the durability The foam with the density of 0.1 to 1.0 g/cc is used, and the one with the density of 0.3 to 0.8 g/cc is preferred.

The present invention will be explained more in detail with respect to embodiments in the attached drawing, which are merely given in the illustration of the invention, but never interpreted to limit the scope thereof.

FIG. 1 is a cross sectional view of an embodiment of the corrosion-preventing structure according to the present invention. In this figure, reference numerals 1, 2, 3 and 4 are reinforced concrete, an adhesive layer, a swelling agent layer and a protective cover, respectively.

According to such a structure, the adhesive layer 2 and the swelling agent layer 3 as integrated together are attached to the reinforced concrete 1 and then the protective cover 4 is press adhered thereto, or after the tape-like adhesive layer 2 is preliminarily wound around the reinforced concrete 1 or bonded thereto, the protective cover 4 with the swelling agent layer 3 bonded to the inner face thereof is applied and attached onto the adhesive layer 2.

In this structure, the corrosion-preventing effect can be exhibited by the adhesive layer, and even if water as a cause of corrosion enters the corrosion-preventing structure, the interior swelling agent absorbs water to be swelled to increase the volume thereof. Consequently, a possible gap through which water enters is clogged. The corrosion-preventing layer is press fitted onto the surface of the reinforced concrete through the swelling pressure caused by the restraint of further expansion. Hence, for instance, even if a projection 7 is present on the reinforced concrete 1; projections 7, 7' and 7'' corresponding to the profile of the projection 7 are formed on the surfaces of the adhesive layer 2 and the swelling agent layer 3, respectively (see FIG. 4); and a gap (a reference numeral 6 in FIG. 4) is formed between the cover 4 and the swelling agent layer 3 even when the swelling agent layer is covered with the protective cover, the gap 6 is buried with the swelling agent layer 3 which has been expanded through swelling due to water absorption to diminish the gap 6 and press fit the adhesive layer 2 onto the surface of the reinforced concrete 1 (see FIG. 5). Between the protective cover 4 and the swelling agent layer 3 may be preliminarily provided a water-absorbing groove or gap for promoting the swelling effect.

Figure 4:
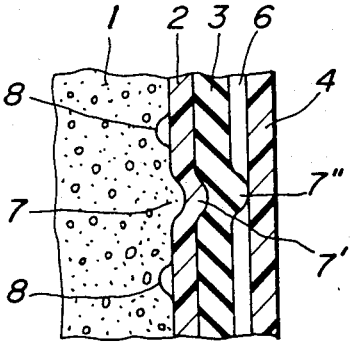
FIG. 4 is a cross sectional view of the corrosion-preventing structure in which an adhesive layer, a swelling agent layer and a protective layer are attached in case that a projection is present on the surface of reinforced concrete.
Figure 5:
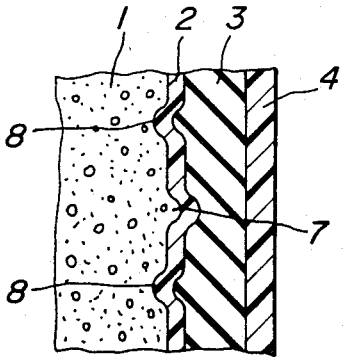
FIG. 5 is a cross sectional view of a corrosion-preventing structure in which gaps of FIG. 4 are diminished through the swelling agent layer of FIG. 4 being swelled due to water absorption.

Further, for instance, when a recess 8 is present on the reinforced concrete as shown in FIG. 4, and the adhesive layer 2, the swelling layer 3 and the protective cover 4 are provided as shown, the recess 8 remains as a gap. However, if the swelling agent layer 3 absorbs water, it is swelled to completely diminish the gap due to the recess 8 as shown in FIG. 5.

Figure 2:
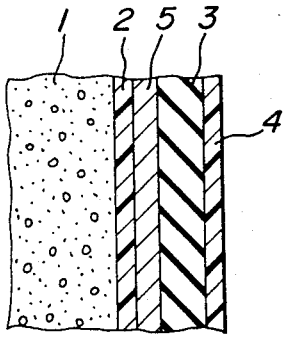
FIG. 2 is a cross sectional view showing another embodiment of the corrosion-preventing structure according to the present invention.

FIG. 2 is a cross sectional view showing amother embodiment of the corrosion-preventing structure according to the present invention. As shown in this figure, a foam layer 5 is further interposed between the adhesive layer 2 and the swelling agent layer 3. Therefore, the press adhering of the adhesive layer 2 onto the surface of the reinforced concrete 1 is further promoted by the expansion of the swelling agent layer and the presence of the foam layer.

According to the corrosion-preventing structure provided with the foam layer, for instance, the tape-like adhesive layer 2 is preliminarily wound around or adhered onto the surface of the concrete 1 and then the protective cover 4 with the swelling agent layer 3 and the foam layer 5 preliminarily laminated onto the inner surface thereof is press fitted thereonto.

Figure 3:
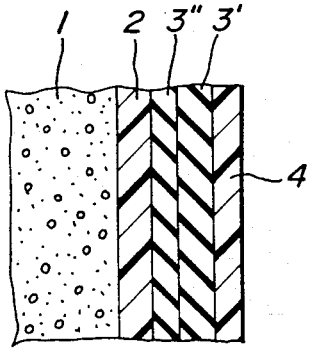
FIG. 3 is a cross sectional view showing a still another embodiment of the corrosion-preventing structure according to the present invention.

FIG. 3 is a cross sectional view of a still another embodiment according to the present invention. In this structure, the swelling agent layer has two different structural sections. That is, only the outer half portion of the swelling agent layer is an original swelling layer 3' in which a water absorbing polymer is blended and the inner half portion thereof is a layer 3'' in which no water-absorbing polymer is blended. The fundamental material of the layer 3'' is the same as that of the outer swelling layer 3', but has no swelling property. The layer 3'' has the waterproof effect, and therefore, more excellent corrosion-preventing effects can be expected.

What is claimed is:

1. A corrosion-preventing structure for protecting reinforcing bars in reinforced concrete to be protected from corrosion, comprising an adhesive layer, a swelling agent layer with a water-absorbing polymer blended therein, and a protective cover layer which layers are successively formed onto the surface of the reinforced concrete.

2. A corrosion-preventing structure according to claim 1, wherein a foam layer is interposed between the adhesive layer and the swelling agent layer.

3. A corrosion-preventing structure according to claim 1, wherein the water-absorbing polymer is blended into the outer half portion of the swelling agent layer only.

4. A corrosion-preventing structure according to claim 1, wherein an adhesive constituting the adhesive layer is made of butyl rubber and a petrolatum adhesive which is a white or brown translucent gelatinous substance being a kind of petroleum waxes isolated through reduced pressure distillation from crude oil and mainly consists of paraffinic and olefinic hydrocarbons.

5. A corrosion-preventing structure according to claim 1, wherein the water-absorbing polymer is a polymer selected from a group consisting of crosslinked polyvinyl alcohol, acrylonitrile-vinyl acetate copolymer, crosslinked polyacrylate, methyl methacrylate-vinyl acetate copolymer, maleic anhydride-isobutylene copolymer, styrene-butadiene-styrene-thioglycolic acid copolymer, styrene-butadiene-styrene maleic anhydride copolymer, hydrophilic polyurethane, and hydrophilic epoxide.

6. A corrosion-preventing structure according to claim 1, wherein the swelling agent layer is constituted by the water-absorbing polymer and a substrate selected from a group consisting of natural rubber (NR), synthesized isoprene rubber (IR), styrene-butadiene copolymer rubber (SBR), butyl rubber (IIR), butadiene rubber (BR), chloroprene rubber (CR), nitrile rubber (NBR), ethylene-propylene rubber (EPR), polyurethane, chlorinated polyethylene, ethylene-vinyl acetate copolymer (EVA), polystyrene, and polyvinyl chloride.

7. A corrosion-preventing structure according to claim 2, wherein the foam layer is made from a closed cell foam of one selected from rubber and plastics.

8. A corrosion-preventing structure according to claim 2, wherein the foam layer is made from rubber or plastics selected from a group consisting of NR, SBR, CR, IIR, BR, EPR, PE, polystyrene, EVA, and polyurethane.

9. A corrosion-preventing structure according to claim 6, wherein the rubber is one selected from synthetic rubber and natural rubber and the plastics is one selected from polyethylene and polypropylene.

* * * * *